US012286269B2

(12) United States Patent
Hon

(10) Patent No.: US 12,286,269 B2
(45) Date of Patent: Apr. 29, 2025

(54) VARIABLE-CAPACITY STORAGE CONTAINER

(71) Applicant: Man Wai Hon, Ma On Shan (HK)

(72) Inventor: Man Wai Hon, Ma On Shan (HK)

( * ) Notice: Subject to any disclaimer, the term of this patent is extended or adjusted under 35 U.S.C. 154(b) by 8 days.

(21) Appl. No.: 18/223,219

(22) Filed: Jul. 18, 2023

(65) Prior Publication Data

US 2024/0051710 A1 Feb. 15, 2024

(30) Foreign Application Priority Data

Aug. 12, 2022 (HK) ..... 32022058348.0

(51) Int. Cl.
*B65D 21/08* (2006.01)
*B65D 1/02* (2006.01)

(52) U.S. Cl.
CPC ..... *B65D 21/086* (2013.01); *B65D 1/0207* (2013.01)

(58) Field of Classification Search
CPC ..... B65D 21/086; B65D 1/0207
USPC ..... 220/666
See application file for complete search history.

(56) References Cited

U.S. PATENT DOCUMENTS 4,930,644 A * 6/1990 Robbins, III ..... B65D 1/02 220/8
5,549,213 A * 8/1996 Robbins, III ..... B65D 43/0212 215/354
5,860,556 A * 1/1999 Robbins, III ..... B65D 1/0292 220/666
2013/0320029 A1* 12/2013 Yourist ..... B65D 1/46 220/672
2015/0083736 A1* 3/2015 Wheeler ..... B65D 21/086 220/666
2015/0314914 A1* 11/2015 Sudakoff ..... B65D 51/1683 220/666
2020/0231324 A1* 7/2020 Swarts ..... B65D 1/0292
2022/0134799 A1* 5/2022 Boese ..... B44D 3/126 220/570
2022/0227530 A1* 7/2022 Cheetham ..... B65D 1/0292

FOREIGN PATENT DOCUMENTS

DE 29914522 U1 * 10/1999 ..... B65D 43/022
GB 2441755 A * 3/2008 ..... B65D 1/0292
JP 3238952 U * 9/2022

* cited by examiner

*Primary Examiner* — J. Gregory Pickett
*Assistant Examiner* — Niki M Eloshway
(74) *Attorney, Agent, or Firm* — Budzyn IP Law, LLC

(57) ABSTRACT

The subject application is directed to a variable-capacity storage container including: a bottom wall and a sidewall connected to an edge of the bottom wall, with the bottom wall and the sidewall being configured to enclose together an accommodation space for accommodating objects; and, an opening part, connected to a side of the sidewall away from the bottom wall. The sidewall is elastic. The opening part, when subjected to pressure, is able to be pushed and moved towards the bottom wall to deform the sidewall; when the sidewall is deformed, at least a part of the sidewall changes from a direction towards the outside of the storage container to a direction towards where the opening part is located. The variable-capacity storage container provided in the present application has an advantage of a simple structure, with high-capacity occupancy rate, volume variation rate, and ease of operation.

20 Claims, 4 Drawing Sheets

VARIABLE-CAPACITY STORAGE CONTAINER

TECHNICAL FIELD

The present application relates to the technical field of storage utensils, and in particular to a variable-capacity storage container.

BACKGROUND

A container is a utensil used to accommodate objects, such as bottles, tanks, boxes, and so on. The container is widely used in the storage and carrying of liquids or solids.

In current conventional application scenarios, the container with type of bottle or tank is usually made of a rigid material with a tank body and a lid adapted to the opening part of the tank. Most containers are not deformable, therefore it needs a larger space for the placement or deposit of the containers.

Although a number of variable-capacity containers are also disclosed in the prior art, these containers usually suffer from various problems, such as a low capacity occupancy rate, a complex structure, a low volume variation rate, and a poor operation during the volume variation process.

SUMMARY

In order to solve or at least partially solve the above technical problems, according to the present application, a variable-capacity storage container is provided, comprising:

a bottom wall and a sidewall connected to an edge of the bottom wall, wherein the bottom wall and the sidewall being enclosed together to form an accommodation space for accommodating objects; and an opening part, connected to a side of the sidewall away from the bottom wall, wherein the sidewall is elastic, and the opening part, when subjected to pressure, is able to be pushed and moved towards the bottom wall to deform the sidewall; in case the deformation occurs at the sidewall, at least a part of the sidewall changes in a direction from a direction towards the outside of the storage container to a direction towards where the opening part is located.

Preferably, wherein the side wall has a density of from 1 g/cm$^3$ to 1.3 g/cm$^3$, and a Shore hardness of from 50 HA to 80 HA.

Preferably, wherein the sidewall exhibits a tensile strength of from 7 MPa to 12 Mpa, an elongation at break of from 200% to 600%, and a tear strength of from 27 KN/m to 35 KN/m.

Preferably, wherein the sidewall and the bottom wall are one-piece molded with a same material, and an average thickness of the bottom wall is greater than an average thickness of the sidewall; or, the sidewall is made of soft material, such as silicone, thermoplastic elastomers (TPE) or some other soft composite material, and the bottom wall can be made of soft material, such as silicone, thermoplastic elastomers (TPE) or some other soft composite material too.

Preferably, wherein a diameter of the opening part is less than a diameter of the bottom wall, and the diameter of the bottom wall is less than a maximum diameter of the sidewall of the storage container in a naturally standing state.

Preferably, wherein the diameter of the opening part is greater than four-fifths of the maximum diameter of the sidewall.

Preferably, wherein a thickness of the sidewall firstly decreases from a direction close to the opening part, and then increases along a direction close to the bottom wall.

Preferably, wherein the thickness of the sidewall gradually decreases and/or increases in a smooth manner, and the thickness of the diameter of the portion of the sidewall connected to the opening part is greater than the diameter of the opening part.

Preferably, wherein a thickness ratio of a maximum thickness of a portion of the sidewall where the decrease in thickness occurs to a thickness of a portion of the sidewall with a minimal thickness is from 3:1 to 1.01:1; a thickness ratio of a maximum thickness of a portion of the sidewall where the increase in thickness occurs to a thickness of a portion of the sidewall with a minimal thickness is from 3:1 to 1.01:1.

Preferably, wherein the thickness ratio of the maximum thickness of the portion of the sidewall where the decrease in thickness occurs to the thickness of the portion of the sidewall with the minimal thickness is 1.8:1; the thickness ratio of the maximum thickness of the portion of the sidewall where the increase in thickness occurs to the thickness of the portion of the sidewall with the minimal thickness is 1.8:1.

Preferably, wherein there is a first distance between a portion of the sidewall with a maximum thickness close to the opening part and a portion of the sidewall with a minimum thickness; there is a second distance between a portion of the sidewall with a maximum thickness close to the bottom wall and a portion of the sidewall with a minimum thickness; a ratio of the first distance to the second distance is in a range of 1:2 to 1:6.

Preferably, wherein the ratio of the first distance to the second distance is 1:4.

BRIEF DESCRIPTION OF THE DRAWINGS

In order to illustrate embodiments of the present application more clearly, a brief introduction of the relevant accompanying drawings will be given below. It will be understood that the accompanying drawings in the following description are only used to indicate some embodiments of the present application, and a person skilled in the art may also obtain many other technical features and connecting relations and the like not mentioned herein on the basis of these accompanying drawings.

REFERENCE SIGNS

1. bottom wall; 2. sidewall; 3. accommodation space; 4. opening part.

DETAILED DESCRIPTION

The present application will be described in detail below in conjunction with the accompanying drawings.

In the Chinese utility model patent with publication number CN203047749U, a variable-capacity container tank is disclosed, inside which a complex structure is configured to realize a volume variation of the container. The structure itself occupies a large space due to complex structure, and therefore the reliability and the capacity occupancy rate are not good enough.

In the Chinese utility model patent with publication number CN212373881U, a sealed container tank with variable capacity is disclosed. It discloses that the volume variation of the container may be realized through the soft elasticity of the tank body. However, in this application, it is only suggested that the flexibility of the wall of the tank body can help the compression of the tank body, but it is not given the specific shape of the tank body being compressed and smaller. The inventor of the present application has found that the container tank produced according to the accompanying drawings disclosed in this patent is prone to distort under pressure, resulting in a waste of a part of the accommodation space and a low volume variation rate. The distortion will further lead to a poor operation during the volume-changing process.

In view of this, the embodiments of the present application provide a variable-capacity storage container in order to obtain, under a smoother operation, a higher reliability, a better capacity occupancy rate, and a greater volume variation rate.

The embodiments of the present application provide a variable-capacity storage container, as shown in FIGS. 1 to 4, comprising:

a bottom wall 1 and a sidewall 2 connected to an edge of the bottom wall 1, wherein the bottom wall 1 and the sidewall 2 being enclosed together to form an accommodation space 3 for accommodating objects; and an opening part 4, connected to a side of the sidewall 2 away from the bottom wall 1.

The sidewall 2 is elastic, and the opening part 4, when subjected to pressure, can be pushed and moved towards bottom wall 1 to deform the sidewall 2; in case the deformation occurs at the sidewall 2, at least a part of the sidewall 2 changes in a direction from a direction towards the outside of the storage container to a direction towards where the opening part 4 is located.

The storage container may further include a lid, being over the opening part 4 to achieve a sealing for the storage container. The opening part 4 may be made of a rigid material, such as hard plastic, metal, etc., and may be connected with the lid by means of screws, snap-fitting, etc.

Figure 1:
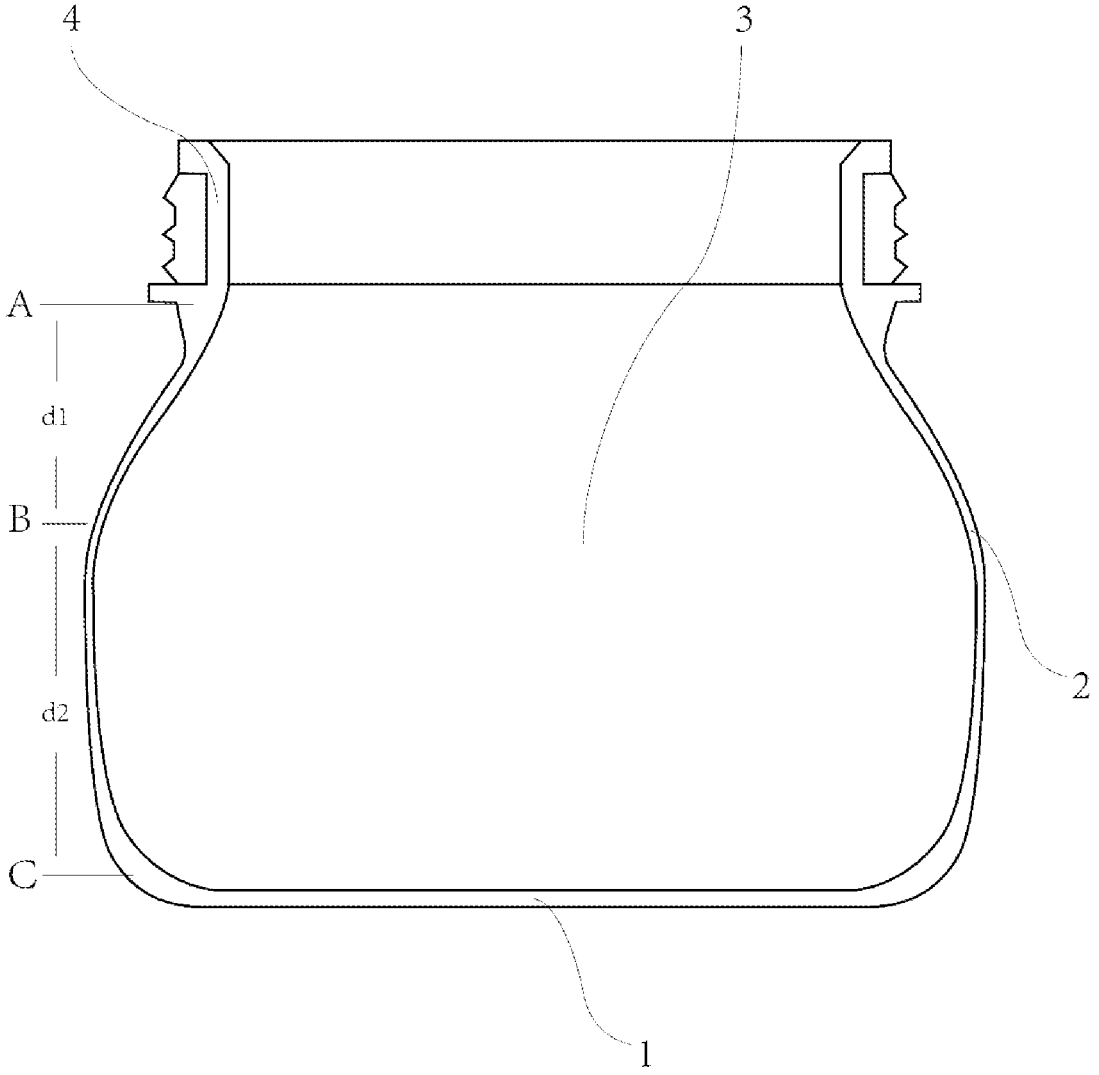
FIG. 1 is a schematic view of a variable-capacity storage container provided in one embodiment according to the present application in a natural state.

The variation process of the storage container of the present application is shown in FIGS. 1 to 4, specifically, 1. Referring to FIG. 1, in an initial state, the storage container of the present application stands on a flat surface and naturally props up the opening part 4.

Figure 2:
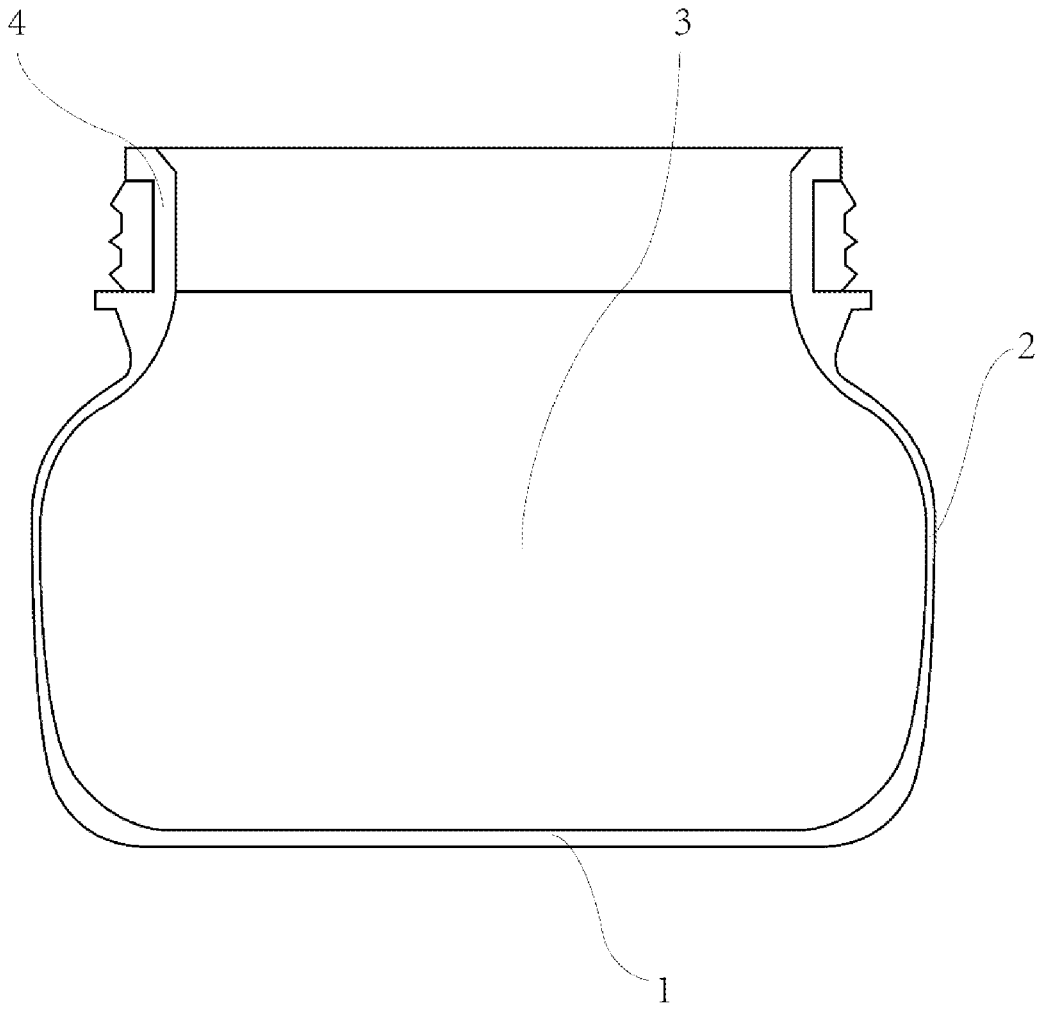
FIG. 2 is a schematic view of a variable-capacity storage container provided in one embodiment according to the present application under a slight pressure.

2. Referring to FIG. 2, the sidewall 2 begins to bend under pressure when the opening part 4 is pressed downwards.

Figure 3:
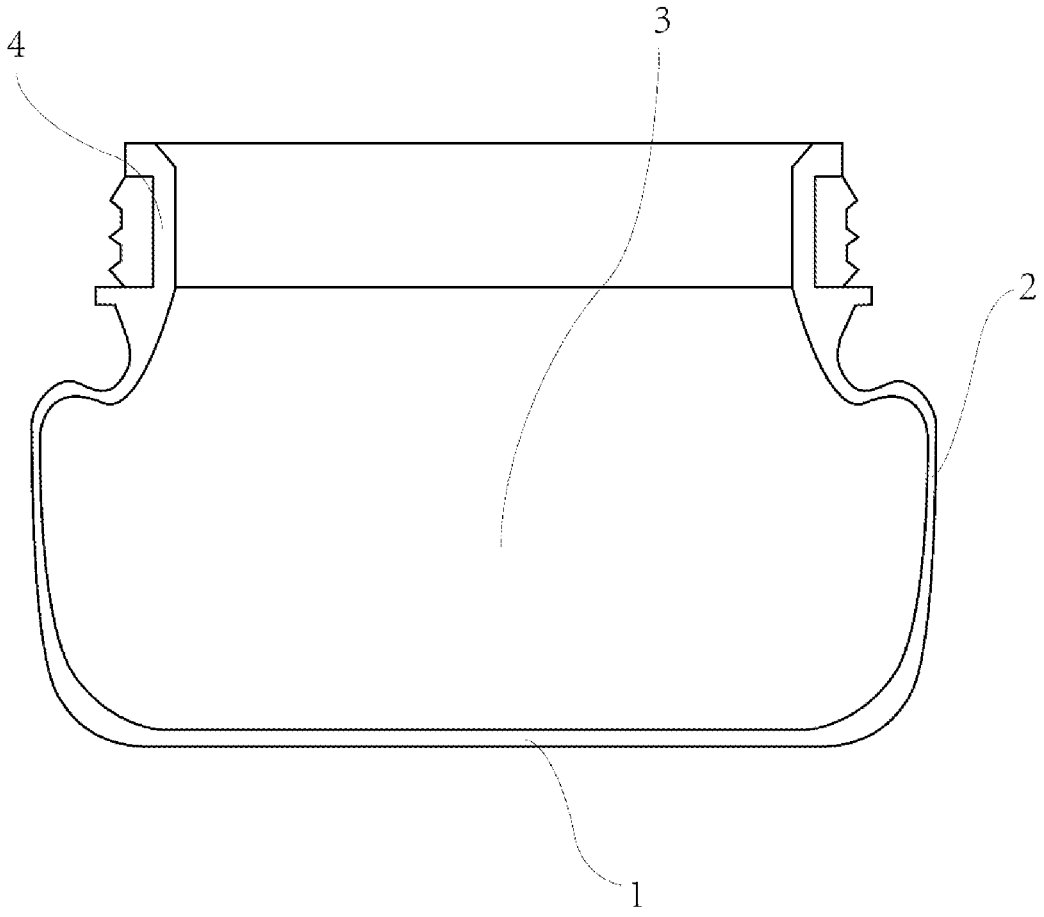
FIG. 3 is a schematic view of a variable-capacity storage container provided in one embodiment according to the present application under a moderate pressure.

3. Referring to FIG. 3, when the pressure increases further, a portion of the sidewall 2 will bend to overlapping with another portion of the sidewall 2 at the same height.

Figure 4:
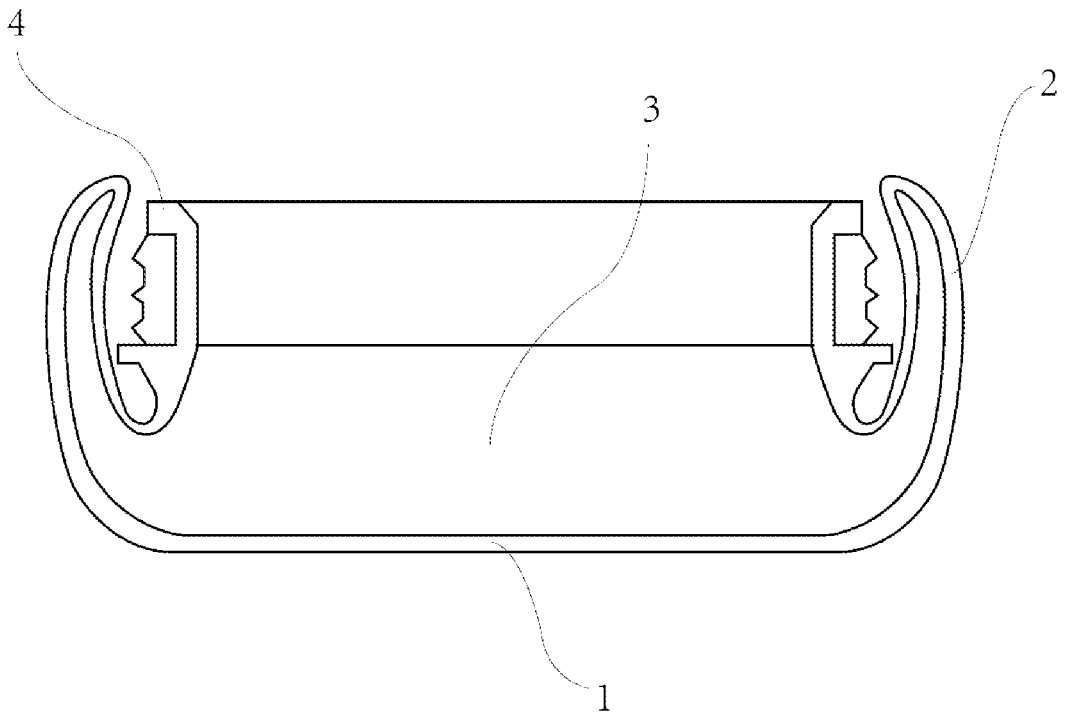
FIG. 4 is a schematic view of a variable-capacity storage container provided in one embodiment according to the present application under a higher pressure.

4. Referring to FIG. 4, under further pressure, the opening part 4 will be pressed down completely and occupy a part of the accommodation space 3. During the process of the opening part 4 being depressed downwards, the sidewall 2 is deformed constantly so that a part of the sidewall 2 changes in a direction from a direction towards the outside of the storage container to a direction towards where the opening part 4 is located. This eventually allows the size of the storage container becoming smaller and reaching a limit condition.

In the embodiment of the present application, because of no demand for configuring an additional deformation structure, the storage container has a large capacity occupancy rate and the structure is thus simplified. Due to the above-mentioned deformation of the sidewall 2, it is not prone to be distorted, which enhances the operation convenience and the space utilization rate of the storage container is thereby improved as well. For the storage container provided in the present application, the user may, according to the actual size of the objects to be put in, stop pressing in any state of FIGS. 1 to 4 or even in the interval therebetween, so as to obtain the required size of the accommodation space 3 dynamically and flexibly. Since the capacity of the storage container after adjustment is bought into line with that of the objects, the space utilization rate can be maximized, and the flexibility can be increased. Moreover, adopting such a design allows the user to remove the air in the container at maximum extent, which is of high importance as a storage container for preventing the oxidation of the food in the storage container.

Optionally, the sidewall 2 has a density of from 1 $g/cm^3$ to 1.3 $g/cm^3$, and a Shore hardness of from 50 HA to 80 HA. The inventor of the present application has found that the density and hardness of sidewall 2 are positively correlated to the self-supporting capacity of sidewall 2. At the condition that the density and hardness are higher, enough supporting force of the sidewall 2 against itself can be ensured, so that even if the accommodation space 3 is left empty, the sidewall 2 can still effectively support the opening part 4 without collapsing by itself. However, excessive density and hardness may make it difficult for the opening part 4 to be pressed down, leading to a deformation difficulty of the storage container. In the embodiment of the present application, selecting the density and hardness in this range can not only have a good load-bearing and supporting function, but also enable an easily deformation of the storage container to under a reasonable range of pressure.

Furthermore, optionally, the sidewall 2 exhibits a tensile strength of from 7 MPa to 12 Mpa, an elongation at break of from 200% to 600%, and a tear strength of from 27 KN/m to 35 KN/m. The inventors of the present application has found that the tensile strength, the elongation at break and the tear strength of the sidewall 2 have an influence on the deformation capacity of the sidewall 2. At the condition that the tensile strength, the elongation at break, and the tear strength are higher, it can not only ensure that the sidewall 2 reaches a sufficient deformation amount, but also expand the capacity of the accommodation space 3 under a limit condition, so that the storage container has a bigger available space.

Optionally, the sidewall 2 and the bottom wall 1 are one-piece molded with the same material, and the average thickness of the bottom wall 1 is greater than the average thickness of the sidewall 2. In terms of manufacturing, one-piece molded has cost advantages, and it is less prone to breakage. Generally speaking, the sidewall 2 may be made of soft material, such as silicone, thermoplastic elastomers (TPE) or some other soft composite material, and the bottom wall 1 can be made of soft material, such as silicone, thermoplastic elastomers (TPE) or some other soft composite material too. The silicone rubber material possesses a good characteristics of ductility and high temperature resistance. When the sidewall 2 and the bottom wall 1 are made of the same material and one-piece molded, the advantages of a simple processing process and low cost are provided.

However, these materials are generally more flexible as compared to the rubber material, but the rubber material has an advantage over these materials in terms of wear resistance and cutting resistance. Accordingly, it is optional to adopt the silicone rubber material for the sidewall 2 and the rubber material for the bottom wall 1. In this way, the advantages of the two materials may be combined and utilized, enabling the storage container to possess a better mechanical performance and a longer service life at the condition with a limited cost.

Furthermore, as for the opening part 4 of the present application, its diameter may be less than the diameter of the bottom wall 1, and the diameter of the bottom wall 1 is less than the maximum diameter of the sidewall 2 of the storage container in a naturally standing state. In other words, an outer diameter of storage container may, from top to bottom, firstly increase and then decrease. By adopting this structure, it can be ensured that the opening part 4 after deformation is incorporated into the original accommodation space 3 of the storage container in the naturally standing state, so as to be sufficiently folded.

Optionally, the diameter of the opening part 4 is greater than four-fifths of the maximum diameter of the sidewall 2. As shown in FIG. 4, by configuring a larger diameter of the opening part 4, it could ensure that a relatively large accommodation space 3 is available at the deformed storage container even if the opening part 4 is fully accommodated into the original accommodation space 3, thus facilitating the placement of a small amount of solids.

It is worth to mention that the diameter of the opening part 4 may also be less than seven-eighths of the maximum diameter of the sidewall 2, thus leaving sufficient deformation space for the folding of the sidewall 2 and avoiding distort of the sidewall 2.

As an important improvement of the embodiment of the present application, optionally, according to FIG. 1, a thickness of the sidewall 2 firstly decreases from the direction close to the opening part 4, and then increases along the direction close to the bottom wall 1.

The configuration of the less thickness for the middle portion of the sidewall 2 and the configuration of the larger thickness of its upper and lower side make it easier to be folded while ensuring the connection strength between the sidewall 2 and the opening part 4 and the bottom wall 1 as well.

Further, the thickness of the sidewall 2 gradually decreases and/or increases in a smooth manner. In this configuration, creases caused by the stepped thickness variation of the sidewall 2, and the tearing phenomenon caused by the local stress concentration led by notch may be prevented, and the strength of the sidewall 2 may be improved.

It is worth to mention that various storage containers in the prior art often demand an additional silicone rubber sealing ring configured in the opening part 4, so that the lid may be tightened against the silicone rubber sealing ring at the opening part 4 to achieve a sealing function. In the present application, the sidewall 2 is made of the silicone rubber material, so that the sealing ring may be molded one-piece with the sidewall 2, and the sealing may be achieved without the addition for the extra silicone rubber sealing ring. Specifically, by thickening the sidewall 2 at the position where the sidewall 2 joints the opening part 4, the thickened portion may obtain the characteristic of a sealing ring and obtain the sealing effect, thereby simplifying the manufacture process and reducing the manufacture cost. In view of this, it is possible to enable the thickness of the diameter of the portion of the sidewall 2 connected to the opening part 4 greater than the diameter of the opening part 4, so that the sidewall 2 itself may undertake the function of the sealing ring.

Furthermore, the thickness ratio of a maximum thickness of a portion of the sidewall 2 where the decrease in thickness occurs to a thickness of a portion of the sidewall 2 with a minimal thickness is from 1.01:1 to 3:1.

The thickness ratio of a maximum thickness of the portion of the sidewall 2 where the increase in thickness occurs to the thickness of the portion of the sidewall 2 with a minimal thickness is from 1.01:1 to 3:1.

In FIG. 1, this is more clearly illustrated. The portion of the sidewall 2 where the decrease in thickness occurs is denoted as A, the portion of the sidewall 2 with a minimal thickness is denoted as B, and the portion of the sidewall 2 where the increase in thickness occurs is denoted as C. It is easy to understand that during the thickness variation of the sidewall 2, after undergoing a rapid thickness decrease, there may be a relatively broad portion where the minimum thickness is maintained, and then the increase in thickness occurs.

In the present application, it is of great positive significance to limit the ratio of the thickness of the middle portion of the sidewall 2 to the thickness of the portions at both side. This is because the inventor of the present application has found that the thickness ratios of various portions of the sidewall 2 is associated with whether the sidewall 2 can be smoothly inserted into the accommodation space 3 under pressure.

When there is no limitation on the thickness ratio of the sidewall 2, the sidewall 2 tends to distort due to an elastic force exerted upon it, and is difficult to be inserted. For example, if the conventional structure in the prior art is adopted, keeping the overall thickness of the sidewall 2 constant, that is, the thickness ratio A:B:C being 1:1:1, the sidewall 2 tends to exhibit a spiral deformation in case the opening part 4 is slapped rapidly with a higher pressure, thus difficult for the opening part 4 to be inserted into the accommodation space 3 under this impact force. In this case, it is necessary to apply a guidance to the sidewall 2 with an external force to slowly complete the deformation process under a less and continuous pressure in order to realize the deformation of the storage container, and its operation process is still relatively complex.

The inventor of the present application has found that in case that the thickness ratio of the various portions of the sidewall 2 is limited in the aforementioned range, pressing the opening part 4 enables the opening part 4 to be smoothly inserted into the accommodation space 3 without the assist of an external force, which contributes to a significantly improvement on feeling in the deformation operation of the storage container.

In addition, generally speaking, in the prior art, in order to realize the folding, it is necessary to provide a folding structure on the side wall 2. Fold structures are usually thinner fold lines. Such folding lines are usually weak points and easy to break. And the folded structure is easy to hide bacteria. By the design above, the present application can make the storage container present an integrated structure. Since no additional folding structure is required, the manufacturing cost should be lower. Since it does not have the weak links, the service life can be significantly extended. In addition, the one-piece structure is easy to clean, which is very important for containers in the food sector.

Further optionally, the thickness ratio of the maximum thickness of the portion of the sidewall 2 where the decrease in thickness occurs to the thickness of the portion of the sidewall 2 with the minimal thickness is 1.3:1.

The thickness ratio of the maximum thickness of the portion of the sidewall 2 where the increase in thickness occurs to the thickness of the portion of the sidewall 2 with the minimal thickness is 4:1.

At the condition of adopting a thickness ratio A:B:C of 1.3:1:1.3, even if the opening part 4 is slapped with great force, the opening part 4 can be slapped into the accommodation space 3 quickly and the deformation process of FIGS. 1 to 4 is complete at a very high speed, which is the best technical solution.

In addition, it is worth to mention that the portion of the sidewall 2 with the minimum thickness, namely the position of the point B, may also have influence on the deformation of the storage container. Optionally, in the embodiment of the present application, there is a first distance d1 between the portion A of the sidewall 2 with the maximum thickness close to the opening part and the portion B of the sidewall with the minimum thickness; there is a second distance d2 between the portion C of the sidewall with the maximum thickness close to the bottom wall and the portion B of sidewall with the minimum thickness; a ratio of the first distance d1 to the second distance d2 may be in the range of 1:2 to 1:6.

It is easy to understand that the length of the three regions A, B and C along the direction of the axis of the container will also have influence on the feeling of folding the container. This is because, once the sidewall 2 undergo a pressure, the deformation occurs firstly at the portion B with minimum thickness, therefore, when the ratio of the first distance d1 and the second distance d2 is in the above ratio range, it is ensured that the region having the relatively long first distance d1 can bend earlier to better guide the deformation process of the storage container. Further optionally, the ratio of the first distance d1 and the second distance d2 may be 1:4. For example, when the first distance is 2.5 cm, the second distance may be 10 cm. By adopting this distance ratio, it is ensured that the deformation of the storage container completes more thoroughly, the deformed accommodation space 3 is larger, and the shape is more scientifical.

Many technical details are presented in the embodiments of the present application. However, even without these technical details and various variations and modifications based on the above-mentioned embodiments, technical solutions claimed to be protected by the various claims of the present application may be substantially realized. Therefore, in practical application, various amendments may be made to the above embodiments in form and in detail without departing from the spirit and scope of the present application.

What is claimed is:

1. A variable-capacity storage container, comprising:

a bottom wall and a sidewall connected to an edge of the bottom wall, the sidewall extending from the edge of the bottom wall to an upper edge, wherein the bottom wall and the sidewall being enclosed together to form an accommodation space for accommodating objects; and an opening part, connected to the upper edge of the sidewall away from the bottom wall, wherein, the sidewall includes contiguous first, second, and third portions with the first portion extending from the upper edge to the second portion, the second portion extending from the first portion to the third portion, and the third portion extending from the second portion to the edge of the bottom wall, a thickness of the sidewall decreases along the first portion from the upper edge to the second portion, the thickness of the sidewall increases along the third portion from the second portion to the edge of the bottom wall, and a minimum thickness of the sidewall being located along the second portion, wherein, the sidewall has a natural standing state, the sidewall having a maximum diameter, in the natural standing state, located on the sidewall at a location closer to the upper edge than the edge of the bottom wall, wherein, with the sidewall in the natural standing state, the junction between the first portion and the second portion is located on the sidewall at a location between the maximum diameter and the upper edge, wherein, with the sidewall in the natural standing state, the first portion and the opening part are wholly located radially inwardly of the maximum diameter, wherein, the sidewall is elastic such that the opening part, when subjected to pressure with the sidewall in the natural standing state, is able to be pushed and moved towards the bottom wall into the accommodation space to deform the sidewall.

2. The variable-capacity storage container according to claim 1, wherein the side wall has a density of from 1 g/cm$^3$ to 1.3 g/cm$^3$, and a Shore hardness of from 50 HA to 80 HA.

3. The variable-capacity storage container according to claim 1, wherein the sidewall exhibits a tensile strength of from 7 MPa to 12 Mpa, an elongation at break of from 200% to 600%, and a tear strength of from 27 KN/m to 35 KN/m.

4. The variable-capacity storage container according to claim 1, wherein the sidewall and the bottom wall are one-piece molded with a same material, and an average thickness of the bottom wall is greater than an average thickness of the sidewall.

5. The variable-capacity storage container according to claim 4, wherein the same material is silicone or thermoplastic elastomer (TPE).

6. The variable-capacity storage container according to claim 1, wherein a diameter of the opening part is less than a diameter of the bottom wall.

7. The variable-capacity storage container according to claim 1, wherein the thickness of the sidewall along the first portion gradually decreases in a smooth manner.

8. The variable-capacity storage container according to claim 1, wherein a thickness ratio of a maximum thickness of the first portion of the sidewall to the minimum thickness is from 3:1 to 1.01:1.

9. The variable-capacity storage container according to claim 8, wherein the thickness ratio is 1.8:1.

10. The variable-capacity storage container according to claim 1, wherein, with the sidewall in the natural standing state:

there is a first distance between a maximum thickness of the first portion and the minimum thickness;

there is a second distance between a maximum thickness of the second portion and the minimum thickness;

a ratio of the first distance to the second distance being in a range of 1.2:1 to 1:6.

11. The variable-capacity storage container according to claim 10, wherein the ratio of the first distance to the second distance is 1:4.

12. The variable-capacity storage container according to claim 1, wherein at least one of the sidewall and bottom wall is formed from silicone or thermoplastic elastomer (TPE).

13. The variable-capacity storage container according to claim 1, wherein the first portion of the sidewall defines a diameter larger than a diameter of the opening part.

14. The variable-capacity storage container according to claim 1, wherein a thickness ratio of a maximum thickness of the second portion of the sidewall to the minimum thickness is from 3:1 to 1.01:1.

15. The variable-capacity storage container according to claim 14, wherein the thickness ratio is 1.8:1.

16. The variable-capacity storage container according to claim 1, wherein a diameter of the bottom wall is less than the maximum diameter of the sidewall in the naturally standing state.

17. The variable-capacity storage container according to claim 1, wherein a diameter of the opening part is greater than four-fifths of the maximum diameter of the sidewall in the naturally standing state.

18. The variable-capacity storage container according to claim 17, wherein the diameter of the opening part is less than seven-eighths of the maximum diameter of the sidewall in the naturally standing state.

19. The variable-capacity storage container according to claim 1, wherein the minimum thickness is maintained over a length of the second portion.

20. The variable-capacity storage container according to claim 1, wherein the opening part is annular and includes an outer surface configured to have a lid connected thereto.

* * * * *